US005699563A

United States Patent [19]

McClure

[11] Patent Number: 5,699,563

[45] Date of Patent: Dec. 23, 1997

[54] FLOAT-CONTROLLED DUAL FLUSH VALVE

[75] Inventor: Richard C. McClure, Claremont, Calif.

[73] Assignee: Fluidmaster, Inc., Anaheim, Calif.

[21] Appl. No.: 674,924

[22] Filed: Jul. 3, 1996

Related U.S. Application Data

[63] Continuation of Ser. No. 409,339, Mar. 23, 1995, abandoned.

[51] Int. Cl.[6] ..... E03D 1/14

[52] U.S. Cl. ..... 4/325; 4/382; 4/404

[58] Field of Search ..... 4/324, 325, 381, 4/382, 383, 384, 394, 395, 403, 404, 405, 410

[56] References Cited

U.S. PATENT DOCUMENTS 4,160,294 7/1979 Crumby ..... 4/324
4,483,024 11/1984 Troeh ..... 4/324

FOREIGN PATENT DOCUMENTS 0528740 2/1993 European Pat. Off. ..... 4/410

*Primary Examiner*—Robert M. Fetsuga
*Attorney, Agent, or Firm*—Freilich Hornbaker Rosen

[57] ABSTRACT

A dual flush valve that can be operated in a partial flush mode to release only about half of the tank water to the toilet bowl, or in a full flush mode to release almost all of the tank water, is of simple and reliable construction. For a partial flushing a chain device (64, FIG. 2) connected to the outer end of the flush member, is pulled to raise the flush member only a small amount (to 14C), and a release mechanism (90) is connected to a separate location on the flush member to keep it up until a float (110) senses that about half of the tank water has been released. The float pivots an arm (102) to disengage a latch 94 on the arm from a catch (96) on the yoke of the flush member to release it. The float slides along the refill/overflow tube (26).

2 Claims, 3 Drawing Sheets

14B
94X
94
76
96B
110
80
120
102
102X
14C
26
110A
110D
92
96C
111
22
90
112

FLOAT-CONTROLLED DUAL FLUSH VALVE

This is a Continuation of application Ser. No. 08/409,339 filed on Mar. 23, 1995 abandoned.

BACKGROUND OF THE INVENTION

There has recently been greater emphasis on reducing water usage, including that used in toilets. One way to reduce such usage is to provide a dual flush valve that can be operated in a partial flush mode to release only half of the water in the tank when there is no solid debris in the toilet bowl. A variety of dual flush valves have been proposed, but they are complex and therefore unreliable and expensive. A dual flush valve which used primarily long-used and reliable toilet pads, including a flush member pivotally mounted on a refill/overflow tube and lifted by a chain that pulls up the outer end of the flush member, and which employed minimal additions and engagements with such long-used members, would be of value.

SUMMARY OF THE INVENTION

In accordance with one embodiment of the present invention, a dual flush valve is provided that uses primarily long-used reliable toilet parts with minimal attachments thereto, to provide for high reliability at low cost. The flush member can be pivoted high off the flush seat for a full flushing, or can be pivoted a small amount off the valve seat for a partial flushing, by a chain device connected to the outer portion of the flush member. A release mechanism that is useful in a partial flushing to hold up the slightly lifted flush member, is coupled to a location on the flush member which is spaced from its outer end where the chain is attached. The release mechanism includes a pivoting arm with a latch at one end that engages a catch mounted on the flush member to hold it up. When about half of the tank water has been released to the toilet bowl, a float starts to move down and pivots the arm so its latch releases the catch to release the flush member so it immediately moves down against the valve seat. The float is movably mounted and preferably vertically slidable along the refill/overflow tube.

The novel features of the invention are set forth with particularity in the appended claims. The invention will be best understood from the following description when read in conjunction with the accompanying drawings.

DESCRIPTION OF THE PREFERRED EMBODIMENT

Figure 1:
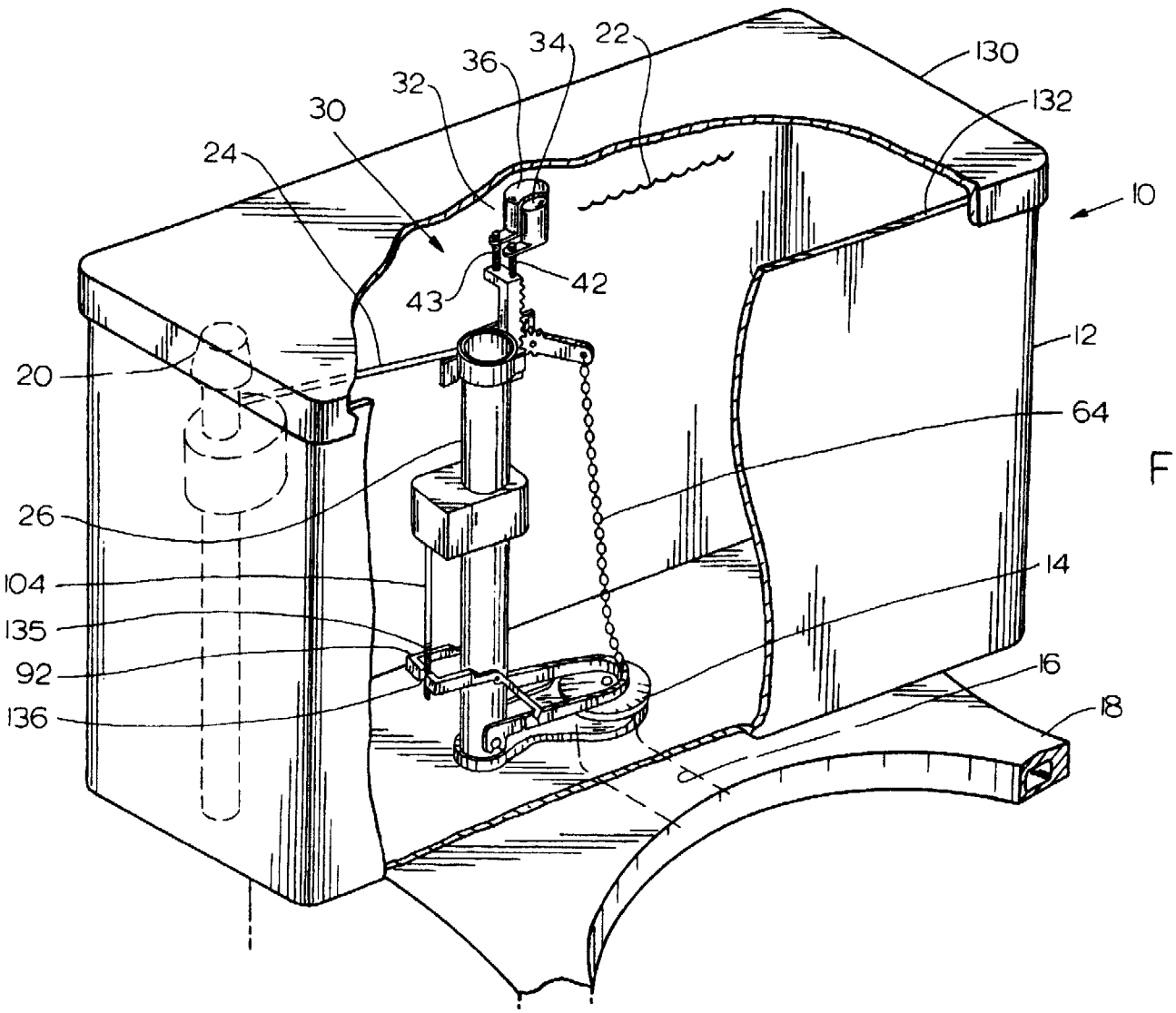
FIG. 1 is a partial isometric view of a toilet showing the dual flush valve of the present invention.

FIG. 1 illustrates a toilet 10 which includes a tank 12 that holds water for a flushing, and a flush member 14 that releases the water to flow through a water tunnel 16 to a toilet bowl 18. After a flushing, an inlet valve 20 flows additional water, as from a city water line, into the tank to refill it to its original level 22, with some water passing through a refill hose 24 to a refill/overflow tube 26 to pass water to the toilet bowl to refill it. FIG. 1 also shows a dual flush valve apparatus 30 which can be operated to release only about half of the tank water to the toilet bowl, which is adequate when there is no solid waste in the toilet bowl. A manually operable control 32 can be used to cause a partial or full flushing.

Figure 2:
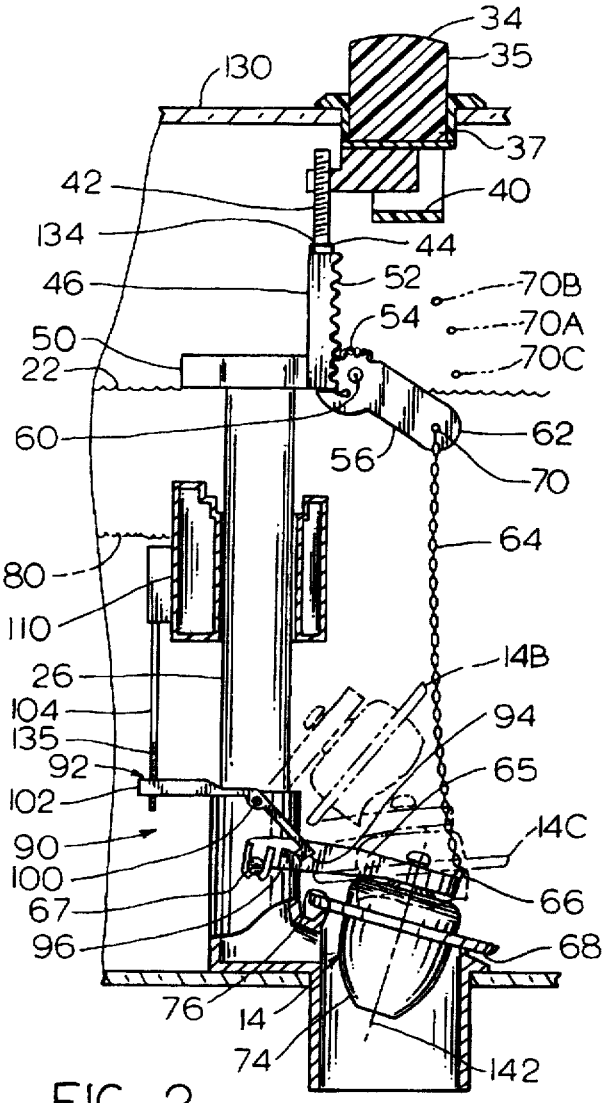
FIG. 2 is a front elevation view of the dual flush valve of FIG. 1, with the flush member in its fully closed position, and showing in phantom lines, the flush member slightly lifted for a partial flush and also lifted high for a full flush.
Figure 3:
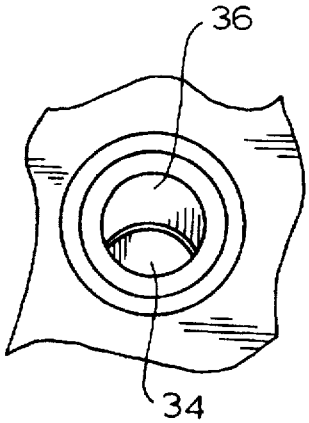
FIG. 3 is a plan view of the toilet of FIG. 2, showing the handle device thereof.

The manual control includes two buttons 34, 36, either of which can be depressed. If a person depresses the partial flush button 34, he causes only half of the tank water to be released, while when he presses the full flush button 36, he causes almost all of the tank water to be released. As shown in FIG. 2, when the partial flush button 34 is depressed, it moves down until stopped by a stop 40. As the button moves down, it moves down an operating member 42 which is in the form of a screw with a head at 44. The screw presses down against an operator 46 in the form of a toothed rack which is vertically slidable on a bracket 50 that is mounted at the top of the overflow tube 26. The teeth 52 of the operator engage teeth 54 on a lever 56 that is pivotally mounted about an axis 60 on the bracket 50. As the operator 46 moves down, it causes the lever 56 to pivot so its outer end 62 moves up and pulls a chain device 64. The lower end of the chain device is attached to a pad eye 66 on the outer portion 68 of the flush member 14. The outer portion 68 forms a sealing surface that lies against the valve seat 76 when the flush member is in a closed position. The flush member includes a yoke 65 that is pivotally mounted at horizontal axis 67 on the overflow tube, and a float part 74 on the yoke, and the flush member is preferably of the construction shown in U.S. Pat. No. 5,293,650 but with a catch at each side of the yoke. It should be understood that some flush members pivot by bending at a thin elastic yoke.

If the chain device upper end 70 moves above an intermediate position 70A, such as to the full flush position 70B, then the chain device will lift the flush member to near the position 14B, and the float part 74 of the flush member will cause the flush member to rise in the water until it reaches the position 14B. This is the position reached during a flushing for a flush member of most toilets, where only a full flushing can be obtained. In that case, the flush member will remain up until the water drops from its initial position 22 to almost the height of the flush valve seat 76, at which time the flush member 14 will pivot down and close the flush valve.

If the partial flush button 34 is depressed, it pivots the lever 56 until the chain device upper end 70 moves to the partial flush position 70C. The flush member 14 then will move to the partial flush position 14C. If the button 34 is immediately released, which is the usual case, then the flush member 14 will immediately tend to pivot down against the valve seat. This is because the float part 74 of the flush member does not lie high enough to provide considerable buoyancy within the tank water, and because the water flowing down through the middle of the valve seat 76 tends to drag down the flush member. A release mechanism 90 is used to keep the flush member in its partially raised state at the partial flush position 14C, until the water level has fallen to a height 80 at which time sufficient water has been released to flush the toilet bowl of liquid matter, and when no further water should be released.

The mechanism 90 for holding the flush member at the partial flush position 14C, includes an arm 92 with a latch 94 at its end, which can engage a catch 96 that is mounted on the flush member 14. The arm 92 is pivotally mounted at 100 on the overflow tube 26, and has an end 102 opposite its latch 94, which is coupled through a rod 104 to a float 110. In FIG. 2, the flush member 14 is down against the valve seat, and the latch 94 merely presses against a surface of the catch 96, without preventing movement of the catch and of the valve member 14.

Figures 4, 5, 6:
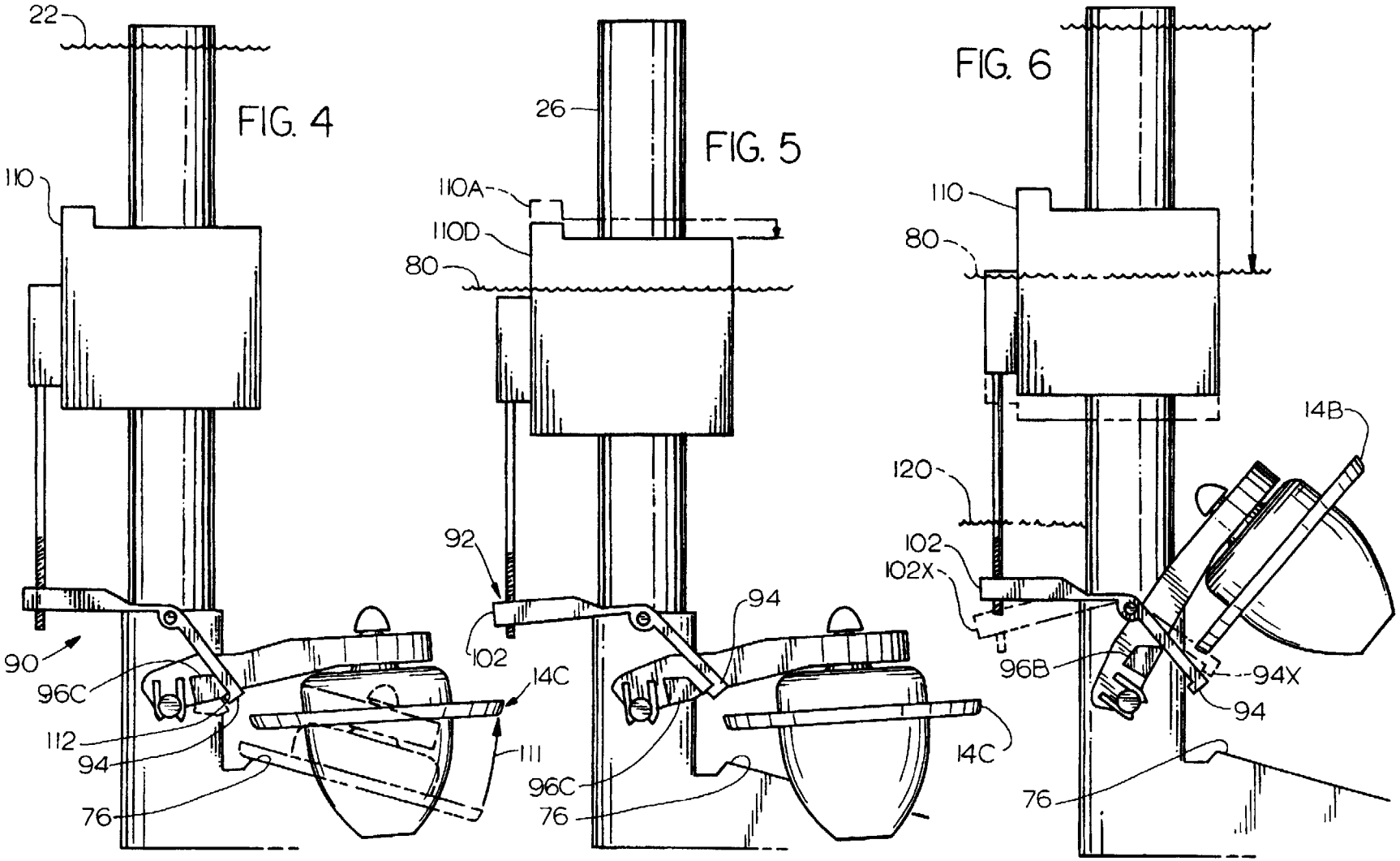
FIG. 4 is a front elevation view of a portion of the dual flush valve of FIG. 3, showing the flush member raised to the partial flush mode, and showing, in phantom lines, the flush member in its fully lowered and closed position.
FIG. 5 is a view similar to that of FIG. 4, that with the water level having dropped significantly, and showing the flush member at the instant where it is released to fall down onto the valve seat.
FIG. 6 is a view similar to that of FIG. 4, but showing the flush member fully pivoted upwardly for the full flush mode, and also showing, in phantom lines, how the arm pivots when the water level falls to about half of its original height.

FIG. 4 shows the valve member at 14C which has been pivoted upwardly as indicated by arrow 111. The flush member has been pivoted sufficiently that a largely downwardly-facing surface 111 of the catch has moved slightly above a corresponding largely upwardly-facing surface on the latch 94. In actuality, the flush member will pivot slightly higher than the position shown in FIG. 4, and, as soon as the partial flush button is released, the flush member will pivot down slightly to the position of FIG. 4. In FIG. 4, the flush member at 14C cannot move down, so water in the tank flows down through the valve seat.

FIG. 5 shows the dual flush apparatus wherein the level of tank water has fallen from the initial position 22 to the position 80. The float 110 is slidably mounted on the overflow tube 26, and moves down with the declining water level from the position 110A to the position 110D. As the float moves down, it moves down the end 102 of the arm 92, with pivoting of the arm causing the latch 94 to be pivoted out of engagement with the catch at 96C. Accordingly, the latch 94 no longer holds up the flush member at 14C, and the flush member immediately moves down under the forces of water rushing out through the middle of the valve seat 76. Thus, when the float at 110 senses that a predetermined amount of water, such as about half of tank water, has been released from the tank, the float moves down and releases the flush member so it can move down and the flush valve can close.

FIG. 6 shows the dual flush apparatus wherein the full flush button has been depressed so the flush member has been raised to near the position 14B and its buoyancy moves it up to the position 14B. As the flush member pivots up, its catch at 96B has merely moved largely upwardly across and beyond the latch 94. As the water in the tank is released, and the water drops to the level 80, the float 110 starts to move down and pivots the arm 102 to the position 102X. In the position 102X, the latch at 94X moves out of the way of the catch at 96B. As a result, a short time later, when the water in the tank reaches the level 120, and the flush member at 14B starts to pivot down with the declining water level, the downwardly urged float 110 keeps the arm and its latch at 102X and 94X, so the latch does not interfere with downward pivoting of the flush member to the original position against the valve seat 76.

Once almost all of the water has been released from the tank, the inlet valve 20 (FIG. 1) senses this and starts to refill the tank. During such refill, the flush valve will be in its closed position. Accordingly, when the rising water level in the tank moves the float 110 upwardly, the rising float 110 merely pivots the arm 92 (FIG. 2) so its latch 94 is in the position shown in FIG. 2, wherein the latch at 94 merely presses against a surface of the catch 96 without preventing the catch and flush member from falling.

As mentioned above, the manually operable handle devices in the form of buttons, are mounted in vertical sliding on the tank cover 130 (FIG. 2) which covers the open top 132 of the tank. By applicant providing an operator 42 which merely presses down against an upwardly-facing surface 134 of the operator 46, applicant is able to easily remove the tank top and replace it, without having to disconnect or reconnect any pads. It may be noted that applicant prefers to provide two operating members 42, 43 (FIG. 1), one for the partial flush button and the other for the full flush button, with the heads of both members 42 pressing against the surface 134.

Figure 8:
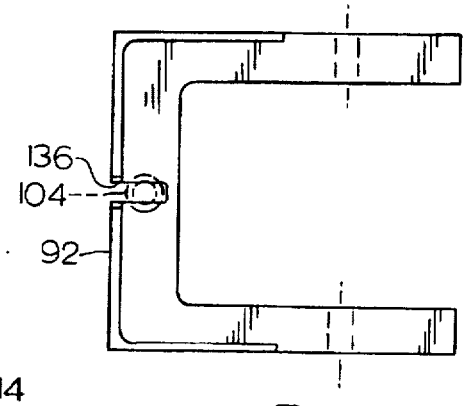
FIG. 8 is a plan view of the arm.
Figure 7:
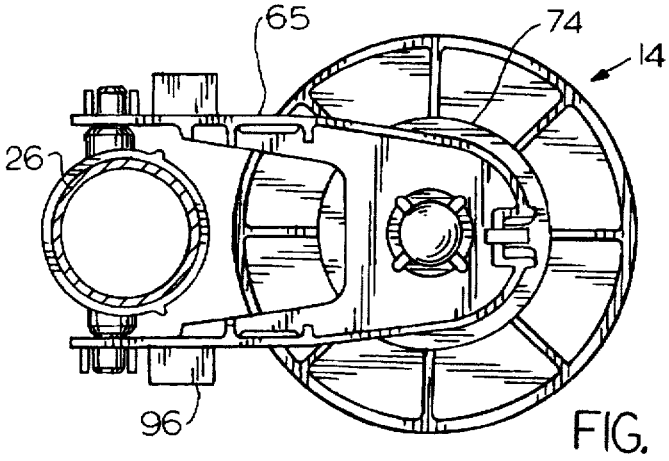
FIG. 7 is a plan view of the flush member.

It may be noted in FIGS. 1 and 8, that the rod 104 has a threaded lower end 135 that threads into a recess in the arm 92. The recess 136 in the arm preferably is a slot with grooves in its side walls forming portions of threads, to facilitate slight pivoting of the arm as the float 110 moves up and down slightly. The threaded rod 104 (FIG. 2) can be turned to raise or lower the float 110 with respect to the arm 102, to change the amount of water that will be released in a partial flush. When the arm latch 94 presses against the catch 96 as in FIG. 2, this limits how far up the float will rise.

Thus, applicant provides a dual flush apparatus which uses primarily the long used components that have been found reliable, in a simple and reliable construction. The flush member is raised by a chain device coupled to its outer portion and preferably its outer end which lies beyond the middle 142 of the float part of a flush member. The chain device is preferably a chain or flexible band, but can be any device coupled to the outer portion of the flush member and which can lift the flush member. In the partial flush mode of operation, the flush member is pivoted up only a small amount, so that if released, it tends to pivot down. A release mechanism operated by a float, holds the flush member in its slightly lifted position, and releases it only when the float senses that about half the tank water has been released. The float is movably and preferably slidably mounted on the overflow tube, which minimizes the number of components. The float operates an arm with a latch that engages a catch mounted on the inner portion of the flush member, which is the portion closer to the pivot axis than the middle of the float part of the flush member.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A dual flush valve apparatus for a toilet that includes a tank for holding water, an overflow tube which extends vertically, a valve seat coupled to a toilet bowl, a pivotable flush member which has an outer portion, and a device which is connected to said flush member outer portion and which can pivot said flush member off said seat to release water to flow to said toilet bowl, said flush member being pivotable downwardly against said seat to stop said water flow, said flush member including a float part that keeps said flush member in an upwardly pivoted portion when said flush member is pivoted at least a predetermined amount off said seat, comprising:

a manually operable control which is operable in a full flush mode to pivot said flush member by more than said predetermined amount for a full flush, and which is operable in a partial flush mode to pivot said flush member by less than said predetermined amount so said flush member tends to immediately pivot down against said seat for a partial flush;

a float that is constructed to slide vertically along said overflow tube and to move down when water in said tank falls below a predetermined partial flush water level; and a release mechanism which is constructed to be coupled to said flush member to keep it pivoted up by less than said predetermined amount and which is coupled to said float so said release mechanism can release said flush member when the float begins to move down.

2. A dual flush valve apparatus for a toilet that includes a tank for holding water, a valve seat coupled to a toilet bowl, a substantially vertical refill tube, and a chain device which can be pulled largely upwardly, wherein said dual flush valve apparatus includes a pivotable flush member which has an outer portion for connection to said chain device wherein said outer portion can be pulled largely upwardly to pivot said flush member off said seat to flow water out to said toilet bowl, said flush member being pivotable downwardly against said seat to stop said water flow, said flush member including a float part that keeps said flush member in an upwardly pivoted portion when said flush member is pivoted by at least a predetermined amount off said seat, comprising:

a manually operable control which is operable in a first mode to pull said chain device to pivot said flush member by at least said predetermined amount for a full flush, and which is operable in a second mode to pull said chain device to pivot said flush member by less than said predetermined amount so said flush member tends to immediately pivot down against said seat for a partial flush;

a float that is vertically slidable along said refill tube and that moves down when water in said tank falls below a predetermined partial flush water level, and a release mechanism which is coupled to said float and which is constructed to be coupled to said flush member independently of said chain device to keep said flush member pivoted off said seat by a partial flush amount which is less than said predetermined amount until said float moves down below said partial flush water level at which time said mechanism releases said float member to allow it to pivot down against said seat.

* * * * *